United States Patent [19]

Nishikawa et al.

[11] Patent Number: 4,592,891

[45] Date of Patent: Jun. 3, 1986

[54] CORROSION-RESISTANT COPPER ALLOY

[75] Inventors: Kiyoaki Nishikawa; Ryoichi Nobuyoshi, both of Kanagawa, Japan

[73] Assignee: Nippon Mining Co., Ltd., Tokyo, Japan

[21] Appl. No.: 725,191

[22] Filed: Apr. 19, 1985

[30] Foreign Application Priority Data

Jun. 14, 1984 [JP] Japan ..... 59-120770
Jul. 26, 1984 [JP] Japan ..... 59-154110

[51] Int. Cl.[4] ..... C22C 9/00; C22C 9/06
[52] U.S. Cl. ..... 420/491; 420/496
[58] Field of Search ..... 420/491, 496

[56] References Cited

U.S. PATENT DOCUMENTS 2,238,592 4/1941 Kelly ..... 420/491
4,427,627 1/1984 Guerlet et al. ..... 420/496

FOREIGN PATENT DOCUMENTS 90946 7/1981 Japan ..... 420/496
198233 12/1982 Japan ..... 420/496
161743 9/1983 Japan ..... 420/491
161744 9/1983 Japan ..... 420/491

*Primary Examiner*—Veronica O'Keefe
*Attorney, Agent, or Firm*—Seidel, Gonda, Goldhammer & Abbott

[57] ABSTRACT

There is disclosed an excellently corrosion-resistant copper alloy suited for use in fabricating fins for heat exchangers, particularly for automobile radiators, which is substantially consisted of 0.005 to 0.1 wt % Pb and 0.01 to 1.0 wt % Co and the remainder Cu with or without the addition of 0.01 to 1.0 wt % one or more of Al, Sn, Mg, Ni, Te, In, Cd, As, Mn, Cr, Ti, Si, Zn, Be, Fe and P.

2 Claims, No Drawings

CORROSION-RESISTANT COPPER ALLOY

FIELD OF THE INVENTION

This invention relates to an excellently corrosion-resistant copper alloy which permits the fabrication of thinner-walled and more durable fins than heretofore for heat exchangers, particularly for automobile radiators.

BACKGROUND OF THE INVENTION

The fins of automobile radiators are joined to radiator tubes and function to dissipate the heat from the heated coolant flowing through the tubes to the atmosphere.

The properties required of the fins, therefore, include thermal resistance and thermal conductivity. As a material that meets these property requirements, tin-containing copper has in recent years come into use.

Nethertheless, there is growing concern about serious corrosion of automobile radiator fins with its fatal effects upon the heat-dissipating function and life of the radiators. These and other problems arise from the aggravation of the environmental conditions with the recent increase in the concentrations of $SO_2$ gas and exhaust emissions in the air, exposure to salty air in coastal regions, deleterious action of melting agents sprinkled over roads after snowfall, and other adverse factors. In addition, the recent tendency in the automobile industry to manufacture vehicles lighter in weight than before has been accompanied with the adoption of thinner radiator fins, so that even slight corrosion of the fins can lead to deteriorated radiator performance.

Under these circumstances the tin-containing copper sheets currently in use for the fabrication of fins are rather susceptible to the corrosive attacks, and therefore the development of a more excellently corrosion-resistant copper alloy has been desired.

SUMMARY OF THE INVENTION

The present invention, now perfected as a result of studies made with the foregoing in view, is concerned with a copper alloy having excellent corrosion resistance as a material for heat exchangers, especially for automobile radiator fins.

We found that a combined addition of Pb and Co each in a specified amount is very effective to improve corrosion resistance. Thus, the invention provides an excellently corrosion-resistant copper alloy consisting substantially of 0.005 to 0.1 wt% lead, 0.01 to 1.0 wt% cobalt, and the remainder copper and inevitable impurities.

Further, it is discovered that when said alloy further includes one or more of Al, Sn, Mg, Ni, Te, In, Cd, As, Mn, Cr, Ti, Si, Zn, Be, Fe and P, superior corrosion resistance is accomplished.

Thus, the invention also provides an excellently corrosion-resistant copper alloy consisting substantially of 0.005 to 0.1 wt% Pb, 0.01 to 1.0 wt% Co, and 0.01 to 1.0 wt% Al, Sn, Mg, Ni, Te, In, Cd, As, Mn, Cr, Ti, Si, Zn, Be, Fe, or P, alone or as a mixture of two or more, and the remainder Cu and inevitable impurities.

EXPLANATION OF THE INVENTION

Now the grounds on which the percentages of the alloying elements constituting the alloy of the invention are limited to the specified ranges will be explained.

The lead content is specified to be in the range of 0.005 to 0.1 wt%, because less than 0.05 wt% lead is not found effective in improving the corrosion resistance of the resulting alloy, while the resistance-improving effect is saturated with more than 0.1 wt% lead and, besides, hot shortness and other deficiencies can present problems in production process.

The cobalt content is confined within the range of 0.01 to 1.0 wt% because if the content is below this range little corrosion-resistance-improving effect is observed and if it is beyond the range its effect of improving the resistance to corrosion and heat both remain saturated and the thermal conductivity of the alloy is reduced.

Lead and cobalt must be combinedly added to copper in accordance with the invention because either element added alone would not appreciably improve the corrosion resistance of the resulting alloy; it is only by the combined addition of the two that the corrosion resistance is markedly improved.

To further enhance corrosion resistance, one or more of Al, Sn, Mg, Ni, Te, In, Cd, As, Mn, Cr, Ti, Si, Zn, Be, Fe, and P are used in an amount of 0.01 to 1.0 wt%. With less than 0.01 wt% of such an element or elements no noticeable effect on increasing the corrosion resistance is achieved. With more than 1.0 wt%, the effects of improving the resistance to corrosion and heat are saturated and the thermal conductivity is lowered.

As described above, the combined addition of Pb, Co, and one or more element selected from Al, Sn, Mg, Ni, Te, In, Cd, As, Mn, Cr, Ti, Si, Zn, Be, Fe and P imparts far greater corrosion resistance to the resulting alloy than the addition of any such element alone.

Since the thermal conductivity of the alloy decreases as the combined amount of these elements added increases, it is desirable that the overall addition amount be not in excess of 1.5 wt% in order to maintain an adequate rate of heat dissipation through the radiator fins.

Alloy embodying the invention will now be described by way of exemplification.

EXAMPLE 1

Alloys of various composition shown in Table 1 were prepared by melting the components. After hot rolling, the workpieces were cold rolled into sheets 0.4 mm thick with appropriate intervention of annealing.

Because investigations revealed that temperature, humidity, and the presence of salt are factors largely responsible for the atmospheric corrosion of radiator fins, following test procedures were used to evaluate the corrosion resistance of the test alloys. Each test piece was exposed to an atmosphere at a temperature of 70° C. and a relative humidity of 90% for 15 days. Artifical sea water, prepared to the composition given in Table 2, was sprayed in an appropriate way during the test period. The test piece was then pickled and the weight loss before and after the test was measured. The weight loss was converted into the basis of the weight reduction per $dm^2$ per day which regarded as its corrosion rate.

As regards thermal resistance, each test sheet, cold rolled to 50% of the final degree of working, was heated to different temperatures, being kept at each temperature for 30 minutes. The temperature at which the cold rolled sheet showed a decrease in hardness to 80% of the original level was taken as its softening temperature. Thermal conductivity was evaluated in terms of the electric conductivity with which it is correlated.

The test results are summarized in Table 3. It will be seen from the table that, as compared with the alloys that contained only lead or cobalt (Nos. 1 to 10) and a conventional alloy (No. 11), the test alloys of the invention (Nos. 12 through 21) exhibited excellent corrosion resistance.

Thus, the alloy according to the invention has outstanding resistance to corrosion and simultaneously has excellent thermal resistance and thermal conductivity. It is therefore an excellent alloy with balanced properties suitable for use as a material for the fins of heat exchangers, especially automobile radiators.

TABLE 1

| | | (wt %) | | | | |
|---|---|---|---|---|---|---|
| | | Co | Pb | Sn | P | Cu |
| Comparative alloy | 1 | 0.01 | — | — | — | bal. |
| Comparative alloy | 2 | 0.07 | — | — | — | " |
| Comparative alloy | 3 | 0.1 | — | — | — | " |
| Comparative alloy | 4 | 0.3 | — | — | — | " |
| Comparative alloy | 5 | 0.9 | — | — | — | " |
| Comparative alloy | 6 | — | 0.006 | — | — | " |
| Comparative alloy | 7 | — | 0.01 | — | — | " |
| Comparative alloy | 8 | — | 0.03 | — | — | " |
| Comparative alloy | 9 | — | 0.06 | — | — | " |
| Comparative alloy | 10 | — | 0.08 | — | — | " |
| Conventional alloy | 11 | — | — | 0.1 | 0.01 | " |
| Alloy of this invention | 12 | 0.01 | 0.007 | — | — | " |
| Alloy of this invention | 13 | 0.3 | 0.01 | — | — | " |
| Alloy of this invention | 14 | 0.06 | 0.04 | — | — | " |
| Alloy of this invention | 15 | 0.7 | 0.09 | — | — | " |
| Alloy of this invention | 16 | 0.9 | 0.08 | — | — | " |
| Alloy of this invention | 17 | 0.2 | 0.03 | — | — | " |
| Alloy of this invention | 18 | 0.1 | 0.01 | — | — | " |
| Alloy of this invention | 19 | 0.05 | 0.006 | — | — | " |
| Alloy of this invention | 20 | 0.4 | 0.02 | — | — | " |
| Alloy of this invention | 21 | 0.6 | 0.05 | — | — | " |

TABLE 2

| | g/l |
|---|---|
| NaCl | 23 |
| $Na_2SO_4.10H_2O$ | 8 |
| $MgCl_2.6H_2O$ | 11 |
| $CaCl_2$ | 2.2 |
| KBr | 0.9 |
| KCl | 0.2 |

TABLE 3

| | | Corrosion rate (mdd) | Conductivity (% IACS) | Softening tmeperature (°C.) |
|---|---|---|---|---|
| Comparative alloy | 1 | 29 | 95 | 270 |
| Comparative alloy | 2 | 27 | 93 | 300 |
| Comparative alloy | 3 | 26 | 92 | 360 |

TABLE 3-continued

| | | Corrosion rate (mdd) | Conductivity (% IACS) | Softening tmeperature (°C.) |
|---|---|---|---|---|
| Comparative alloy | 4 | 24 | 63 | 370 |
| Comparative alloy | 5 | 23 | 51 | 390 |
| Comparative alloy | 6 | 28 | 100 | 200 |
| Comparative alloy | 7 | 27 | 100 | 200 |
| Comparative alloy | 8 | 25 | 99 | 200 |
| Comparative alloy | 9 | 24 | 99 | 200 |
| Comparative alloy | 10 | 24 | 98 | 200 |
| Conventional alloy | 11 | 30 | 85 | 360 |
| Alloy of this invention | 12 | 16 | 94 | 270 |
| Alloy of this invention | 13 | 12 | 62 | 370 |
| Alloy of this invention | 14 | 12 | 94 | 300 |
| Alloy of this invention | 15 | 10 | 60 | 370 |
| Alloy of this invention | 16 | 8 | 50 | 390 |
| Alloy of this invention | 17 | 11 | 80 | 360 |
| Alloy of this invention | 18 | 13 | 90 | 360 |
| Alloy of this invention | 19 | 14 | 94 | 300 |
| Alloy of this invention | 20 | 11 | 60 | 370 |
| Alloy of this invention | 21 | 10 | 55 | 370 |

EXAMPLE 2

This example illustrates enhanced corrosion resistance by the addition of one or more of Al, Sn, Mg, Ni, Te, In, Cd, As, Mn, Cr, Ti, Si, Zn, Be, Fe and P to Pb-Co-Cu system. Test sheets of alloys of various compositions shown in Table 4 were made in the same manner as in the Example 1. Although the alloy 3 is a Pb-Co-Cu alloy in the scope of the invention, it is listed as comparative alloy herein for the comparison purpose. Conventional alloy 8 is the same as the conventional alloy 11 in the Example 1. Table 5 summarizes the test results. The test procedure was the same as described in the Example 1 except that the test period was extended from 15 days to 25 days. It will be appreciated from the table that the test alloys of the invention to which Pb, Co, and one or more element selected from Al, Sn, Mg, Ni, Te, In, Cd, As, Mn, Cr, Ti, Si, Zn, Be, Fe and P were combinedly added (Nos. 9 through 29) proved superior in corrosion resistance to the comparative alloys 1–7 and a conventional alloy 8.

TABLE 4

| | Pb | Co | Al | Sn | Mg | Ni | Te | In | Cd | As | Mn | Cr | Ti | Si | Zn | Be | Fe | P | Cu |
|---|---|---|---|---|---|---|---|---|---|---|---|---|---|---|---|---|---|---|---|
| Comparative alloy 1 | 0.023 | — | — | — | — | — | — | — | — | — | — | — | — | — | — | — | — | — | bal. |
| Comparative alloy 2 | — | 0.38 | — | — | — | — | — | — | — | — | — | — | — | — | — | — | 0.004 | — | " |
| Comparative alloy 3 | 0.017 | 0.11 | — | — | — | — | — | — | — | — | — | — | — | — | — | — | — | — | " |
| Comparative alloy 4 | — | — | — | — | — | 0.30 | — | — | — | — | 0.14 | — | — | — | — | — | — | — | " |
| Comparative alloy 5 | — | — | — | 0.19 | — | — | 0.08 | — | — | — | — | — | — | — | — | — | — | — | " |
| Comparative | — | — | — | — | — | — | — | — | 0.038 | — | — | — | — | — | 0.16 | — | — | — | " |

TABLE 4-continued

| | Pb | Co | Al | Sn | Mg | Ni | Te | In | Cd | As | Mn | Cr | Ti | Si | Zn | Be | Fe | P | Cu |
|---|---|---|---|---|---|---|---|---|---|---|---|---|---|---|---|---|---|---|---|
| alloy 6 | | | | | | | | | | | | | | | | | | | |
| Comparative alloy 7 | — | 0.07 | — | — | 0.15 | — | — | — | — | — | — | — | — | — | — | — | — | 0.03 | " |
| Conventional alloy 8 | — | — | — | 0.1 | — | — | — | — | — | — | — | — | — | — | — | — | — | 0.01 | " |
| Alloy of this invention 9 | 0.006 | 0.19 | 0.08 | — | — | — | — | — | — | — | — | — | — | — | — | — | — | — | " |
| Alloy of this invention 10 | 0.016 | 0.10 | — | 0.12 | — | — | — | — | — | — | — | — | — | — | — | — | — | — | " |
| Alloy of this invention 11 | 0.020 | 0.42 | — | — | 0.09 | — | — | — | — | — | — | — | — | — | — | — | — | — | " |
| Alloy of this invention 12 | 0.008 | 0.30 | — | — | — | 0.47 | — | — | — | — | — | — | — | — | — | — | — | — | " |
| Alloy of this invention 13 | 0.073 | 0.09 | — | — | — | — | 0.33 | — | — | — | — | — | — | — | — | — | — | — | " |
| Alloy of this invention 14 | 0.041 | 0.16 | — | — | — | — | — | 0.08 | — | — | — | — | — | — | — | — | — | — | " |
| Alloy of this invention 15 | 0.036 | 0.39 | — | — | — | — | — | — | 0.15 | — | — | — | — | — | — | — | — | — | " |
| Alloy of this invention 16 | 0.009 | 0.81 | — | — | — | — | — | — | — | 0.09 | — | — | — | — | — | — | — | — | " |
| Alloy of this invention 17 | 0.089 | 0.50 | — | — | — | — | — | — | — | — | 0.31 | — | — | — | — | — | — | — | " |
| Alloy of this invention 18 | 0.010 | 0.22 | — | — | — | — | — | — | — | — | — | 0.14 | — | — | — | — | — | — | " |
| Alloy of this invention 19 | 0.023 | 0.15 | — | — | — | — | — | — | — | — | — | — | 0.18 | — | — | — | — | — | " |
| Alloy of this invention 20 | 0.054 | 0.19 | — | — | — | — | — | — | — | — | — | — | — | 0.33 | — | — | — | — | " |
| Alloy of this invention 21 | 0.035 | 0.18 | — | — | — | — | — | — | — | — | — | — | — | — | 0.18 | — | — | — | " |
| Alloy of this invention 22 | 0.027 | 0.03 | — | — | — | — | — | — | — | — | — | — | — | — | — | 0.09 | — | — | " |
| Alloy of this invention 23 | 0.081 | 0.62 | — | — | — | — | — | — | — | — | — | — | — | — | — | — | 0.19 | | " |
| Alloy of this invention 24 | 0.015 | 0.71 | — | — | — | — | — | — | — | — | — | — | — | — | — | — | — | 0.05 | " |
| Alloy of this invention 25 | 0.007 | 0.15 | — | — | 0.16 | — | — | — | — | 0.04 | — | — | — | — | — | — | 0.09 | — | " |
| Alloy of this invention 26 | 0.019 | 0.11 | — | — | — | — | 0.13 | — | — | — | — | — | 0.21 | — | — | — | — | — | " |
| Alloy of this invention 27 | 0.013 | 0.21 | 0.07 | — | 0.13 | 0.20 | — | — | — | — | — | — | — | — | — | — | — | — | " |
| Alloy of this invention 28 | 0.022 | 0.19 | — | — | — | — | — | 0.11 | — | — | 0.17 | — | — | — | 0.02 | — | 0.10 | — | " |
| Alloy of this invention 29 | 0.016 | 0.15 | — | — | — | — | — | — | 0.08 | — | — | 0.06 | — | 0.18 | — | 0.04 | — | — | " |

TABLE 5

| | | Corrosion rate (mdd) | Conductivity (% IACS) | Softening temperature (°C.) |
|---|---|---|---|---|
| Comparative alloy | 1 | 29 | 99 | 200 |
| Comparative alloy | 2 | 34 | 58 | 380 |
| Comparative alloy | 3 | 20 | 82 | 230 |
| Comparative alloy | 4 | 31 | 52 | 350 |
| Comparative alloy | 5 | 29 | 83 | 290 |
| Comparative alloy | 6 | 30 | 72 | 260 |
| Comparative alloy | 7 | 31 | 68 | 270 |
| Conventional alloy | 8 | 30 | 86 | 360 |
| Alloy of this invention | 9 | 17 | 72 | 330 |
| Alloy of this invention | 10 | 13 | 73 | 320 |
| Alloy of this invention | 11 | 12 | 60 | 380 |
| Alloy of this invention | 12 | 15 | 52 | 360 |
| Alloy of this invention | 13 | 9 | 84 | 390 |

TABLE 5-continued

| | | Corrosion rate (mdd) | Conductivity (% IACS) | Softening temperature (°C.) |
|---|---|---|---|---|
| Alloy of this invention | 14 | 11 | 80 | 320 |
| Alloy of this invention | 15 | 13 | 58 | 380 |
| Alloy of this invention | 16 | 14 | 51 | 420 |
| Alloy of this invention | 17 | 7 | 57 | 400 |
| Alloy of this invention | 18 | 12 | 74 | 340 |
| Alloy of this invention | 19 | 13 | 76 | 320 |
| Alloy of this invention | 20 | 8 | 71 | 340 |
| Alloy of this invention | 21 | 8 | 73 | 330 |
| Alloy of this invention | 22 | 13 | 85 | 250 |
| Alloy of this invention | 23 | 9 | 59 | 370 |
| Alloy of this invention | 24 | 14 | 56 | 410 |
| Alloy of this invention | 25 | 15 | 68 | 320 |
| Alloy of this invention | 26 | 13 | 60 | 360 |

TABLE 5-continued

| | | Corrosion rate (mdd) | Conductivity (% IACS) | Softening temperature (°C.) |
|---|---|---|---|---|
| Alloy of this invention | 27 | 15 | 51 | 370 |
| Alloy of this invention | 28 | 15 | 53 | 380 |
| Alloy of this invention | 29 | 14 | 52 | 360 |

What we claim is:

1. An corrosion-resistant copper alloy consisting essentially of 0.005 to 0.1 wt% lead; 0.01 to 1.0 wt% cobalt; and the remainder copper and inevitable impurities.

2. A corrosion-resistant copper alloy consisting essentially of 0.005 to 0.1 wt % of Pb; 0.01 to 1.0 wt % Co; 0.01 to 1.0 wt % of one or more elements selected from the group consisting of Al, Sn, Mg, Ni, Mn, Si, Zn, or P; and having a total amount of added elements of not more than 1.5 wt % and the remainder Cu and inevitable impurities.

* * * * *